US010125467B2

(12) United States Patent
Jung et al.

(10) Patent No.: US 10,125,467 B2
(45) Date of Patent: Nov. 13, 2018

(54) TEMPLATE FOR AND METHOD OF INSTALLING A PLURALITY OF FOUNDATION ELEMENTS IN AN UNDERWATER GROUND FORMATION

(75) Inventors: Boudewijn Casper Jung, Bergen op Zoom (NL); Jan Albert Westerbeek, Spijkenisse (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 13/172,911

(22) Filed: Jun. 30, 2011

(65) Prior Publication Data

US 2012/0014753 A1 Jan. 19, 2012

(30) Foreign Application Priority Data

Jul. 2, 2010 (EP) ..... 10168348

(51) Int. Cl.

| | |
|---|---|
| ***E02D 13/04*** | (2006.01) |
| ***E02D 13/00*** | (2006.01) |
| ***E02D 27/42*** | (2006.01) |
| ***E02D 27/50*** | (2006.01) |

(52) U.S. Cl.

CPC ..... *E02D 13/04* (2013.01); *E02D 13/00* (2013.01); *E02D 27/42* (2013.01); *E02D 27/50* (2013.01)

(58) Field of Classification Search

CPC ..... E02D 13/04; E02D 13/00; E02D 27/42; E02D 27/50

USPC ..... 405/203, 211, 216, 224, 227, 228

See application file for complete search history.

(56) References Cited

U.S. PATENT DOCUMENTS

| | | | | |
|---|---|---|---|---|
| 2,651,181 | A * | 9/1953 | Alcorn et al. | 405/204 |
| 3,667,571 | A * | 6/1972 | Fattelay | F01B 31/005 173/DIG. 2 |
| 3,754,403 | A * | 8/1973 | Mott et al. | 405/196 |
| 4,319,647 | A * | 3/1982 | Browning | B28D 1/221 175/14 |
| 4,625,804 | A | 12/1986 | Allen, Jr. | |
| 4,687,062 | A * | 8/1987 | Beghetto et al. | 166/366 |
| 4,740,107 | A * | 4/1988 | Casbarian et al. | 405/211 |
| 4,808,037 | A * | 2/1989 | Wade | E02B 17/00 166/55 |

(Continued)

FOREIGN PATENT DOCUMENTS

| | | | |
|---|---|---|---|
| DE | 1784396 | 7/1971 | |
| GB | 2469190 A * | 10/2010 | E02D 5/285 |

(Continued)

OTHER PUBLICATIONS

Extended European Search Report dated Nov. 24, 2010 of European patent application No. 10168348.0.

(Continued)

*Primary Examiner* — Jessica H Lutz

(74) *Attorney, Agent, or Firm* — Steven M. Koehler; Westman, Champlin & Koehler, P.A.

(57) ABSTRACT

A template for use in installing a plurality of foundation elements, in particular anchor piles, relative to one another in an underwater ground formation is provided. The template includes a plurality of guides for the foundation elements, which guides are fixed relative to one another by means of a frame. At least one of the guides includes a sound-insulating sleeve for surrounding a foundation element during driving.

22 Claims, 2 Drawing Sheets

(56) References Cited

U.S. PATENT DOCUMENTS

| | | | | |
|---|---|---|---|---|
| 5,244,312 | A * | 9/1993 | Wybro et al. | 405/204 |
| 5,526,882 | A * | 6/1996 | Parks et al. | 166/339 |
| 5,551,804 | A | 9/1996 | Breaux et al. | |
| 5,722,796 | A * | 3/1998 | Halvorsen et al. | 405/195.1 |
| 5,807,029 | A * | 9/1998 | Ellnor | 405/204 |
| 6,036,404 | A * | 3/2000 | De Medeiros, Jr. | B63B 21/502 166/359 |
| 6,325,158 | B1 * | 12/2001 | Rangnes et al. | 175/5 |
| 7,476,056 | B2 * | 1/2009 | Dreyer | 405/228 |
| 9,410,403 | B2 * | 8/2016 | Wochner | E21B 41/007 |
| 9,488,026 | B2 * | 11/2016 | Wochner | E21B 33/10 |
| 2005/0083783 | A1 * | 4/2005 | Baskerville et al. | 367/1 |
| 2008/0226398 | A1 * | 9/2008 | Gibberd | E02D 5/40 405/223 |
| 2009/0129871 | A1 | 5/2009 | Mohr | |
| 2010/0119309 | A1 * | 5/2010 | Gibberd | 405/228 |
| 2012/0177447 | A1 * | 7/2012 | Fraenkel | E02D 5/285 405/232 |
| 2013/0011203 | A1 * | 1/2013 | Reinhall | E02D 5/24 405/228 |
| 2014/0154015 | A1 * | 6/2014 | Jung | E02D 13/00 405/184.1 |
| 2015/0078833 | A1 * | 3/2015 | Elmer | E02D 13/00 405/195.1 |
| 2015/0110564 | A1 * | 4/2015 | West | E02D 3/10 405/227 |

FOREIGN PATENT DOCUMENTS

| | | | |
|---|---|---|---|
| JP | S56064026 | U | 6/1981 |
| JP | S59-195333 | U | 12/1984 |
| JP | 60-159218 | | 8/1985 |
| JP | S61-112052 | U | 7/1986 |
| JP | H11100845 | A | 4/1999 |
| WO | 2007096132 | A1 | 8/2007 |
| WO | 2010/043845 | A1 | 4/2010 |
| WO | 2010043845 | A1 | 4/2010 |

OTHER PUBLICATIONS

Article Hydroacoustic Measurements During Pile Driving at the Hood Canal Bridge, T.J. Carlson et al., Sep. through Nov. 2004.

JP 60159218 English translation of abstract.

State Intellectual Property Office of the People's Republic of China for corresponding Chinese Application No. 201110177573.8, Notification of the Second Office Action, date of notification Apr. 13, 2015.

Notice of Reasons for Rejection for Japan application No. 2011-142700, drafted Oct. 9, 2014, dated Oct. 14, 2014.

* cited by examiner

TEMPLATE FOR AND METHOD OF INSTALLING A PLURALITY OF FOUNDATION ELEMENTS IN AN UNDERWATER GROUND FORMATION

CROSS-REFERENCE AND PRIORITY CLAIM TO RELATED APPLICATIONS

This application claims priority to European Patent Application No. 10168348.0, filed on 2 Jul. 2010, entitled "Template for and method of installing a plurality of foundation elements in an underwater ground formation" which application is incorporated herein by reference and made a part hereof in its entirety.

SUMMARY

The invention relates to a template for use in installing a plurality of foundation elements, in particular anchor piles for a jacket for e.g. a wind turbine, relative to one another in an underwater ground formation. The template comprises a plurality of guides for the foundation elements, which guides are fixed relative to one another by means of a frame. The invention also relates to a method of installing a plurality of foundation elements.

As explained in European patent publication 1 989 358, offshore ramming work is carried out under water to establish foundations, for example, for drilling platforms and wind turbines. For wind turbines, large monopiles with a diameter of more than four meters are rammed into the seabed. This ramming results in a substantial underwater noise input, which can have a negative impact on e.g. marine fauna. To reduce the noise input underwater, in the method and device according to EP 1 989 358, the material that is to be rammed is surrounded by a fixed flooded sleeve. The sleeve advantageously has a sandwich-like structure.

T. J. Carlson et al., "Hydroacoustic Measurements During Pile Driving at the Hood Canal Bridge, September Through November 2004" discloses a HDPE pipe sleeve that fits over a 24 inch pile and reaches from a point above water to the ground elevation below water. The mentioned sleeve diameter and wall thickness are 34 inch and 1⅜ inch, respectively.

Some structures require other solutions than a monopile. For instance, for wind turbines the diameter of the required monopile increases with the depth of the waters where the wind turbines are to be installed. Depths exceeding e.g. 30 meters may require such dimensions that a monopile is impractical or indeed impossible. In such circumstances, a jacket, such as a so-called tripod, provides a suitable alternative. Jackets are also used in other applications, e.g. for oil and gas platforms and for supporting water current (tidal) energy plants.

It is an object of the present invention to enable installing foundation elements for e.g. wind turbines in deeper waters, with reduced noise input.

To this end, the present invention provides a template that is characterized in that at least one of the guides comprises a sound-insulating sleeve for surrounding a foundation element during driving.

If all of the guides comprise a sound-insulating sleeve and the sleeves extend parallel to each other, all piles can be installed with the template remaining substantially stationary. When installation of all piles is complete the template is lifted over the usually relatively short extending ends of the installed piles and moved to the next installation site.

If the template comprises a single sleeve and, e.g., three or four guides having a triangular or square footprint, respectively, it is possible, after a first pile has been installed, to lift and rotate the entire template, over 120° or 90°, respectively, and to reposition the template using the installed pile(s) as a reference, and then install the next pile. However, it is preferred that the base of the template stays in place and that the sleeve is detached from the base of the template, lifted over the installed pile, and moved to the next position (guide).

In an embodiment, the sleeve comprises features to further attenuate noise generated by the driving of the foundation element. For instance, the wall of the at least one sleeve may contain one or more chambers, e.g. be double-walled, and/or be made of a composite material, e.g. be lined with a sound absorbing material and optionally an additional inner wall, the walls and liner together forming a sandwich.

In an embodiment, the sleeve comprises one or more guide elements on its inner wall, which elements, to reduce transmission of noise from the driver to the sleeve, preferably comprise a noise damping material, such as rubber. To improve guiding, especially during lowering the foundation element in the sleeve and during driving the foundation element, it is preferred that guide elements are located at least near the bottom of the sleeve and in its upper half. The guide elements also facilitate maintaining a sufficient and substantially uniform distance of e.g. at least 30 centimeters between the pile and the sleeve.

In general, it is preferred that the sum of all measures aimed at attenuating noise, results in a total reduction of the noise input from the driving by at least 10 dB, preferably at least 15 dB for frequencies lower than 1000 Hz, when compared to driving without a sleeve.

The invention further relates to a method of installing a plurality of foundation elements, in particular anchor piles for a jacket for e.g. a wind turbine, relative to one another in an underwater ground formation, comprising the steps of placing a template comprising a plurality of guides for the foundation elements and at least one sound-insulating sleeve on the ground formation, placing a foundation element in the sleeve and driving the foundation element into the ground formation, lifting the template over the ends of the installed foundation element extending above the ground formation, placing a jacket over the ends of the installed foundation elements and securing the jacket to the foundation elements.

In an embodiment, all of the guides comprise a sound-insulating sleeve, a foundation element is placed in each of the sleeves and driven into the ground formation.

In an alternative embodiment, after driving a first foundation element into the ground formation, the sleeve is moved to another guide or the template is rotated and placed with another of the guides over the installed foundation element and a second foundation element is placed in the sleeve and driven into the ground formation.

For the sake of completeness, attention is drawn to the following documents.

JP 60-159218 discloses a sound insulator for a pile hammer comprising sound insulating cylinders, which are formed from a resilient material and in the shape of bellows. The sound insulating cylinders are secured around a pile.

DE 1 784 396 discloses a pile driving hammer comprising a telescopic sound absorbing sleeve.

U.S. Pat. No. 5,551,804 discloses (in FIG. 1) a jacket that doubles as a pile driving template. The legs of the jacket diverge, which in practice implies that the pilings rest on or at least contact the legs of the jacket and the noise from the driver is transmitted to the surrounding water unattenuated and might even be amplified (resonance). Also, due to the divergence of the legs, the jacket cannot be removed after the piles have been installed and the jacket cannot be re-used. In consequence, the jacket is not a true template, at least not a template within the meaning of the present invention which requires it to be re-used for installing further foundation elements on other sites.

The invention will now be explained in more detail with reference to the Figures, which show a preferred embodiment of the present template and method.

It is noted that the Figures are schematic in nature and that details, which are not necessary for understanding the present invention, may have been omitted.

DETAILED DESCRIPTION

Figure 1:
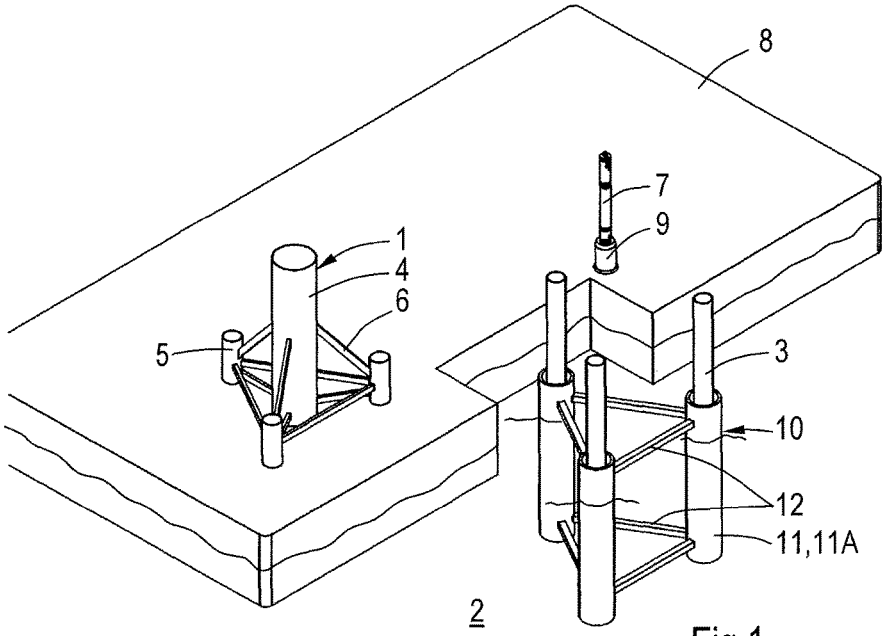
FIG. 1 is a perspective view of a system for installing a foundation element comprising a first template according to the present invention.

FIG. 1 shows a system for installing a jacket 1 in an underwater ground formation, e.g. a seabed 2, by means of anchor piles 3. In this example, the jacket 1 comprises a central cylinder 4 and a plurality of hollow cylindrical support members or feet 5 connected to the central cylinder 4 by means of a frame 6 and arranged in a pattern, i.c. a triangle (when seen from the top). The central cylinder has a circular cross-section, a diameter of five meters, and is intended to serve, after installation of the jacket on the seabed, as the foundation of a wind turbine. The anchor piles 3 have a circular cross-section, an outer diameter of two meters and a length of 50 meters.

The system further comprises an hydraulic driver 7, e.g. an IHC Hydrohammer S-500 or S-800, connected to a power pack on board of a surface vessel, such as a jack-up barge or floating barge 8. The driver 7 comprises a driver sleeve 9 for securely mounting the driver 7 on an anchor pile 3 and an anvil (hidden from view by the driver sleeve) for transmitting impact energy from the driver 7 to the anchor pile 3. The barge 8 comprises a crane (not shown) to lift and manipulate the anchor piles, the driver, the jacket, et cetera.

The system further comprises a template 10 for positioning and driving a plurality of anchor piles in the seabed in a predetermined pattern corresponding that of the support members of the jacket. The template comprises a plurality of guides 11 for the piles which guides are fixed relative to each other by means of a frame 12. In the embodiment shown in FIG. 1, each guide 11 comprises a sound-insulating sleeve 11A, made of e.g. steel, for surrounding a pile during driving to reduce noise input from the driver into the surrounding water. The pattern of the centrelines of the sleeves corresponds to that of the support members of the jacket, i.e. in this example the sleeves are arranged in a triangle.

Each sleeve has a circular cross-section, is double walled, and has an inner diameter of three meters. The double wall provides one or more chambers for air or a porous material and renders the template buoyant at least to some extent.

In general, to reduce or substantially avoid excessive penetration of the template into the seabed under its own weight and to facilitate removal of the template after the anchor piles have been installed, it is preferred that buoyancy, i.e. the weight of the displaced water, is at least 60% preferably at least 80% of the weight of the template. In an embodiment, buoyancy is variable, e.g. through a system of valves, compressors or pumps, and (ballast) chambers that enable letting in and expelling water.

The inner wall of the sleeve is provided with a plurality of guide elements (hidden from view), in this example two sets of guide wheels made of a noise damping material, such as rubber, and arranged in a ring along the (inner) circumference of the sleeve, both near its bottom and somewhere in its upper half, in this example at a few meters from it upper rim. Separating the sets of guide elements in the axial direction provides a substantial guiding length and thus further increases stability of the piles during driving.

In general, it is preferred that, once the template is in place, the sound-insulating sleeves extend from the ground formation to above the water level. The upper rim of each of the sleeves can be provided with a detachable extender, to adjust the effective length of sleeve to the depth of the water at the location where the foundation elements are to be installed.

Installation of a jacket is carried out for instance as follows. The template is lifted from the deck of the barge and lowered into the sea until it rests in a vertical position on the seabed. Alternatively, the template is afloat or resting on the seabed near the barge and the template is lifted and/or towed to the envisaged site from there. Once in place, each of the anchor piles is lifted over the template and lowered into one of the sleeves and onto the seabed and, if required by the circumstances, allowed to penetrate the seabed to some extent under its own weight.

Then, the driver is lifted from the deck of the barge and placed on top of the first anchor pile and this pile is driven into the seabed to a depth which corresponds to, e.g., 95% of its length, with the upper end of the anchor pile extending typically from 1 to 6 meter above the seabed. During part of the driving the driver is inside the sleeve and, if the sleeve is flooded, under water. When driving of the first anchor pile is completed, the driver is lifted, removed from the first sleeve, and placed onto the second anchor pile. This process is repeated until all anchor piles are installed in the seabed.

Subsequently, the driver is placed back on deck and the template is lifted and either placed on deck or rendered buoyant, e.g. by emptying ballast chambers, and left afloat or placed aside on the seabed. In the latter two instances, the template needs to be lifted only a few meters, i.e. just high enough to safely clear the upper ends of the installed anchor piles.

Figure 2:
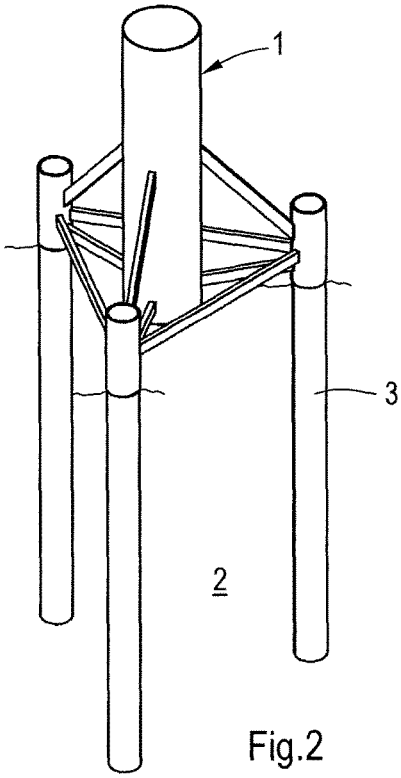
FIG. 2 is perspective view of a tripod installed by means of a template according to the present invention.

With the template now out of the way, the jacket is placed with its support members over the anchor piles and secured to the same, e.g. by grouting or welding, and the installation of the jacket is completed, as shown in FIG. 2.

Figure 3:
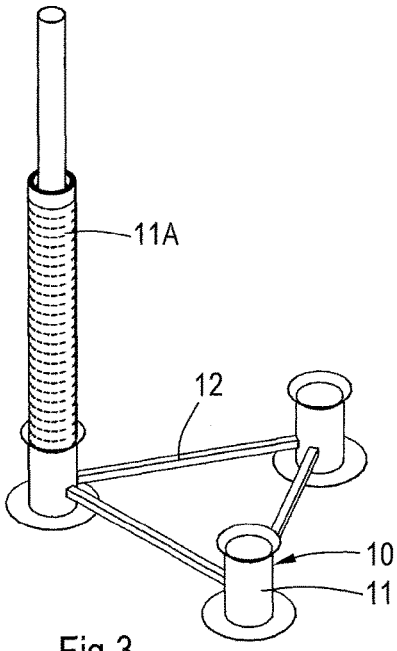
FIG. 3 is a perspective view of a second template according to the present invention.
Figure 4:
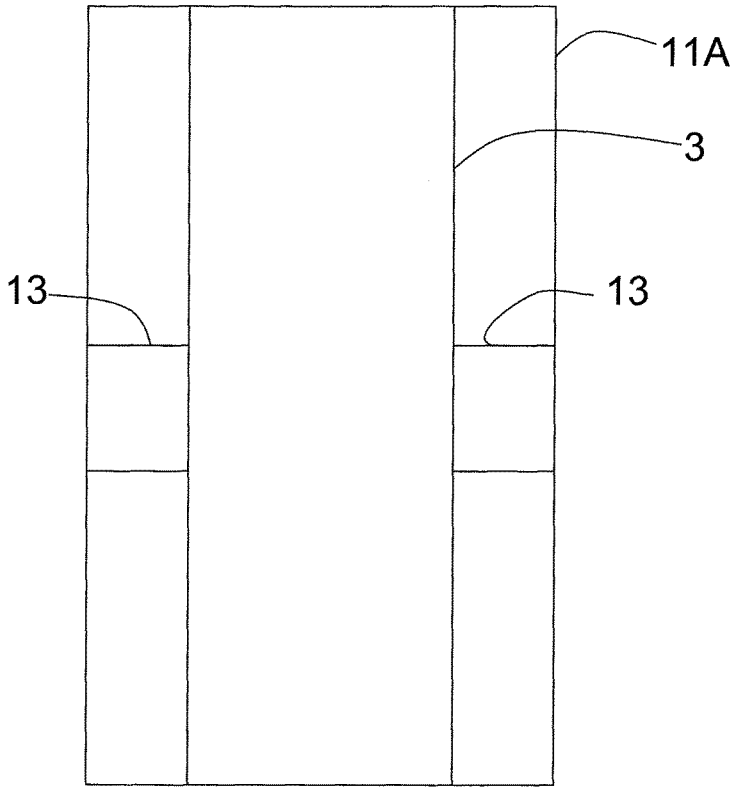
FIG. 4 is a schematic illustration of a pile having guide elements.

FIG. 3 is a perspective view of a second template 10 according to the present invention comprising a plurality of guides, i.c. hollow cylinders 11 having flared ends, and a single sleeve 11A. The sleeve 11A is in most respects identical to the sleeve described above, except that it is removable from the guides. To this end, the outer diameter of the sleeve 11A is slightly smaller than the inner diameter of the cylinders 11.

After the first pile has been installed, the sleeve is lifted over the end of the installed pile and moved to the next position. At this position, a second pile is placed in the sleeve and driven into the seabed. This process is repeated until all anchor piles are installed in the seabed. Placing and securing the jacket is performed in the way as described above.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention is not restricted to the embodiment described above and can be varied in numerous ways within the scope of the claims.

The invention claimed is:

1. A removable, reusable template for use in installing a plurality of foundation elements relative to one another in an underwater ground formation, comprising a plurality of guides for the foundation elements, wherein the guides are fixed relative to one another by a frame, wherein at least one of the guides comprises a sound-insulating double wall construction sleeve having at least one air chamber configured to render the template buoyant, the sleeve configured to surround a foundation element during driving, and wherein the guides are configured to be placed on the underwater ground formation during use, the sound-insulating sleeve being tubular, and extending upwardly and surrounding the foundation element from the underwater ground formation to above the water level.

2. The template according to claim 1, wherein all of the guides comprise a sound-insulating sleeve, said sleeves extending parallel to each other.

3. The template according to claim 1, wherein the sleeve is movable from one guide to another guide.

4. The template according to claim 1, comprising three guides.

5. The template according to claim 1, wherein a wall of the sleeve is made of a composite material.

6. The template according to claim 1, wherein the sleeve comprises one or more guide elements on its inner wall.

7. The template according to claim 6, wherein the one or more guide elements are at least near the bottom of the sleeve and in its upper half of the sleeve.

8. The template according to claim 6, wherein the one or more guide elements comprise a noise damping material.

9. The template according to claim 1, wherein sleeve reduces the noise input from the driving by at least 10 dB.

10. The template according to claim 1, wherein the sleeve reduces the noise input from the driving by at least 15 dB for frequencies lower than 1000 Hz.

11. The template according to claim 1, wherein the buoyancy of the template is at least 60%.

12. The template according to claim 1, wherein the buoyancy of the template is at least 80%.

13. The template of claim 6, wherein the guide elements are axially separated from each other so as to provide a guide length to guide the foundation element during driving.

14. The template of claim 1, wherein the sleeve is configured to stand erect and have an inner wall spaced apart from the foundation element during driving.

15. A method of installing a plurality of foundation elements, relative to one another in an underwater ground formation, comprising:

placing a template comprising a plurality of guides for the foundation elements and at least one tubular sound-insulating sleeve having a double wall construction on the underwater ground formation, the sound-insulating sleeve engaging the underwater ground formation and supporting itself upon the underwater ground formation so as to extend upwardly and surround the foundation element from the underwater ground formation to above a water level, next inserting a foundation element into the at least one sound-insulating sleeve and driving the foundation element into the underwater ground formation, lifting the template over ends of the installed foundation elements extending above the underwater ground formation, placing a jacket over the ends of the installed foundation elements and securing the jacket to the foundation elements;

wherein, at least during driving, the at least one sound-insulating sleeve fully surrounds the foundation element with the double wall construction from the underwater ground formation to above the water level.

16. The method according to claim 15, wherein all of the guides comprise a sound-insulating sleeve and a foundation element is placed in each of the sleeves and driven into the underwater ground formation.

17. The method according to claim 15, wherein, after driving a first foundation element into the underwater ground formation, the sleeve is moved to another guide or the template is rotated and placed with another of the guides over the installed foundation element and a second foundation element is placed in the sleeve and driven into the underwater ground formation.

18. The method according to claim 15, wherein, at least during driving, the clearance between the foundation element and the sleeve is in excess of 30 cm.

19. The method according to claim 15, wherein water is removed from the sleeve such that, at least during part of driving, at least a driver is separated from an inner wall of the sleeve by air.

20. The template according to claim 1, wherein the outer diameter of the sleeve is smaller than the inner diameter of the at least one of the guides.

21. The method according to claim 15, wherein the outer diameter of the at least one sound-insulating sleeve is smaller than the inner diameters of the plurality of guides.

22. A removable, re-usable template for use in installing a plurality of foundation elements relative to one another in an underwater ground formation, comprising:

a plurality of guides for the foundation elements, wherein the guides are fixed relative to one another by a frame, wherein at least one of the guides comprises a sound-insulating sleeve configured to surround a foundation element during driving, and wherein the guides are configured to be removably placed on the underwater ground formation during use, the sound-insulating sleeve engaging the underwater ground formation and having a double wall cylinder construction supporting itself upon the underwater ground formation so as to extend upwardly and surround the foundation element from the underwater ground formation to above the water level, the double wall construction comprising at least one chamber.

* * * * *